United States Patent [19]

Brooke

[11] 4,004,802

[45] Jan. 25, 1977

[54] SHEET STRIPPING DEVICE

[75] Inventor: Edric R. Brooke, Welwyn Garden City, England

[73] Assignee: Xerox Corporation, Stamford, Conn.

[22] Filed: Oct. 3, 1975

[21] Appl. No.: 619,419

[30] Foreign Application Priority Data

Nov. 20, 1974 United Kingdom ..... 50317/74

[52] U.S. Cl. ..... 271/174; 271/DIG. 2

[51] Int. Cl.[2] ..... B65H 29/54

[58] Field of Search ..... 271/174, DIG. 2, 80, 271/172; 118/60, 245; 432/60

[56] References Cited

UNITED STATES PATENTS

| | | | |
|---|---|---|---|
| 2,034,903 | 3/1936 | Hernlund | 271/DIG. 2 |
| 2,842,362 | 7/1958 | Hayes | 271/DIG. 2 |
| 3,343,834 | 9/1967 | Mazzio | 271/172 |
| 3,820,776 | 6/1974 | Fujimoto | 271/DIG. 2 |

*Primary Examiner*—Richard A. Schacher

[57] ABSTRACT

A device for stripping sheet material from a sheet carrying surface moving relative thereto including a finger having a sheet contacting portion at a first end adjacent said sheet carrying surface to contact the lead edge of a sheet of material on said surface, said finger being pivoted about a point spaced from and upstream of said sheet contacting portion whereby the pivot point is behind the lead edge of said sheet material when it is engaged by said sheet contacting portion.

5 Claims, 6 Drawing Figures

FIG. 1.
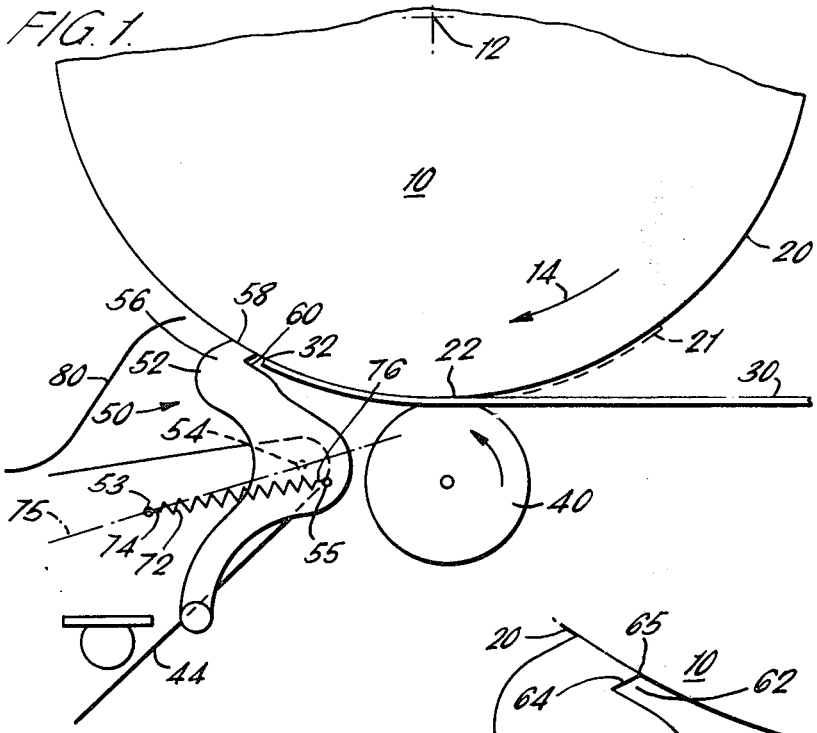
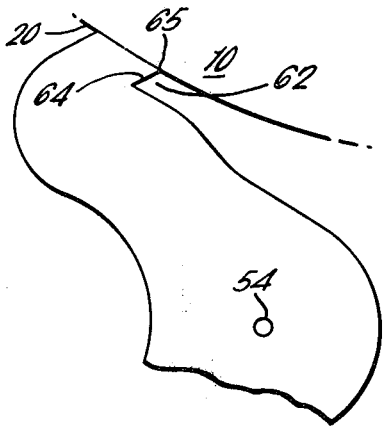
FIG. 2.
FIG. 3
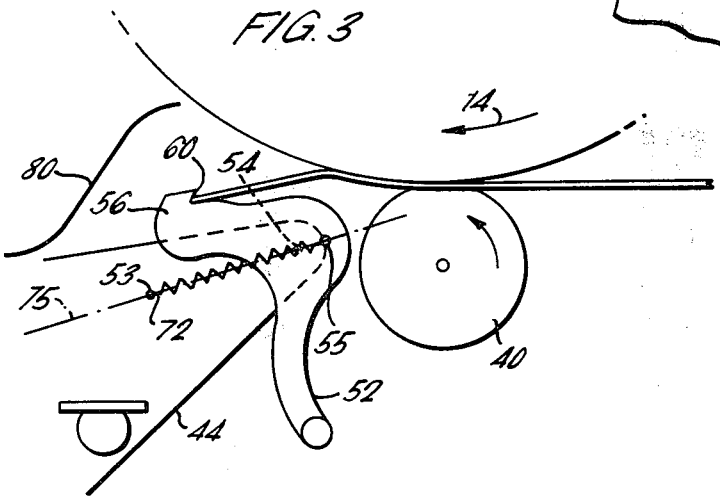

FIG. 4.
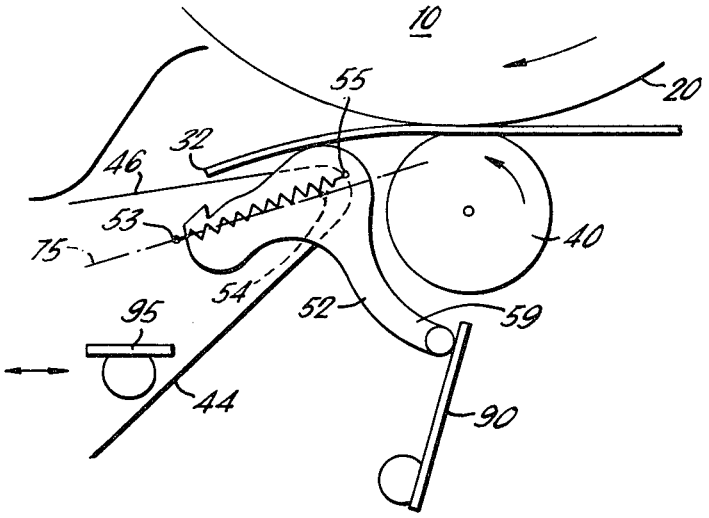
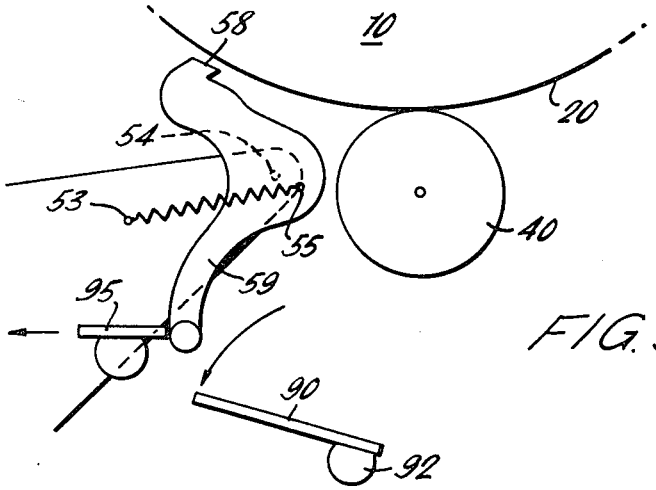
FIG. 5.

SHEET STRIPPING DEVICE

This invention generally relates to sheet handling technology and more particularly concerns a means for removing sheet material from a sheet carrying surface.

In one well known form of automatic electrostatographic reproduction machine, a moving photoconductive plate or photoreceptor, generally in the form of an endless surface, such as a drum or the like, is uniformly charged and the surface then exposed to a light pattern of the image sought to be reproduced to thereby discharge the charge in the areas where light strikes the plate. The undischarged areas of the layer thus form an electrostatic charge pattern in conformity with the configuration of the original image pattern.

This electrostatic latent image may then be developed into visible form by applying a developer material, either a powder or liquid to the plate using any one of a number of development means generally known and used in the art. Subsequent to the development operation, the now visible image is transferred from the plate to a sheet of final support material, or carrier, such as paper or the like, and suitably affixed to it thereby forming a permanent print.

The transfer step includes bringing the developed photoreceptor surface into contact with the surface of the image support material, effecting the transposition of the developed image from the photoreceptor surface to the support material surface by suitable means while the two are in contact and separating the imaged bearing carrier sheet from the photoreceptor.

Because of the strong electrostatic attraction between the carrier sheet and the photoreceptor, separation cannot depend upon gravity but usually requires an additional external force. Presently proposed means to provide the external stripping force include a finger which contacts the lead edge of the paper and wedges itself between the sheet carrying surface and the sheet. These proposals have many inherent disadvantages. For example, the reactive force from the stripping action causes the finger to press harder on to the relatively sensitive photoreceptive surface which may produce relatively high wear or damage.

Moreover, with this arrangement the finger has to remain in contact with the drum surface until the full length of the sheet material has passed by it. This further aggravates wear. Since the finger is contacting the imaged side of the sheet material being stripped, the opportunity for the finger to smear or obliterate the developed image is always present. If more than one finger is used paper damage will be caused if one sheet strips and the other sheet does not. If only one finger is used, its failure to strip may be catastrophic for the machine.

According to the present invention there is provided a device for stripping sheet material from a sheet carrying surface moving relative thereto including a finger having a sheet contacting portion at a first end adjacent said sheet carrying surface to contact the lead edge of a sheet of material on said surface, said finger being pivoted about a point spaced from and upstream of said sheet contacting portion whereby the pivot point is behind the lead edge of said sheet material when it is engaged by said sheet contacting portion.

A device for stripping sheet material according to the invention will now be described by way of example with reference to the accompanying drawings, in which:

FIG. I is a schematic elevational view of the stripping device in operative position adjacent a drum shaped sheet carrying surface just prior to contact with the lead edge of a sheet of material;

FIG. 2 is an enlargement of a portion of the device of FIG. I showing the relationship between the sheet contacting portion and the sheet carrying surface;

FIG. 3 is a view similar to FIG. I showing the stripping device in a position before the lead edge is released;

FIG. 4 is a view similar to FIG. I illustrating the stripping device at an over-centre position below the surface of the sheet release means;

FIG. 5 is a view similar to FIG. 4 with the stripping device held just out of contact with the sheet carrying surface by the stop means.

Figure 6:
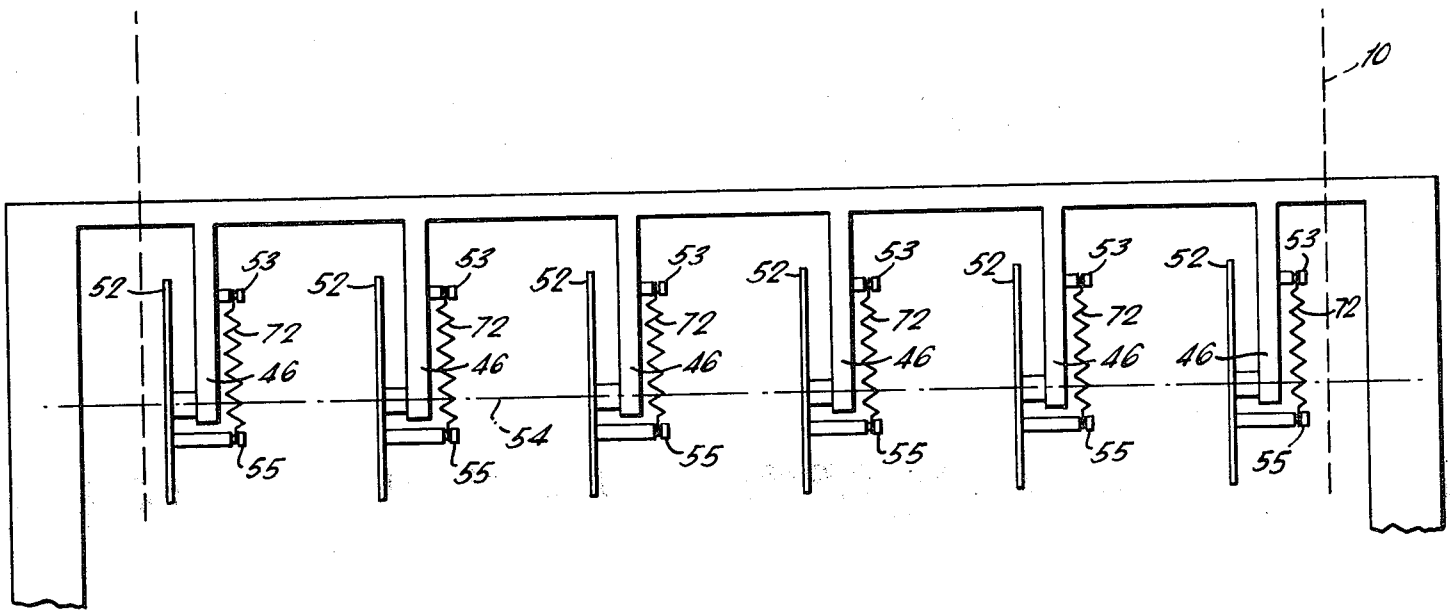
FIG. 6 is side view of a structure similar to FIG. I to illustrate how a plurality of stripping devices may be arranged across a sheet material carrying surface.

Referring to FIG. I, a photoreceptor 10 having a sheet material carrying surface 20 is rotatable about an axis 12 in a direction indicated by the arrow 14. The surface 20 also carries a developed image 21 from a develop station not shown to a transfer zone 22. In the process a sheet of image supporting material 30 moving in timed relation to the surface 20 is brought into contact with the developed image 21 on surface 20 in the transfer zone 22. Application of a suitable electrical bias to the sheet material 30 by means such as shown for example by the transfer roll 40 causes the development image 21 to release from the surface 20 and transfer to the surface 31 of the sheet material. This transfer step causes the sheet material 30 to be attracted to the surface 20 such that an external separating force must usually be applied to separate one from the other.

According to the present invention this external force is provided by a stripping device generally indicated at 50 which includes a finger 52 pivotally mounted at a point 54 on a support 44. The finger has a first end generally indicated at 56 on which is located a carrier contacting area 58 and a sheet contacting portion 60. As shown the portion 60 is about to be contacted by a lead edge 32 of the sheet material 30. The point 54 may be said to be upstream of portion 60, that is, in this embodiment the lead edge 32 must pass the radial on which point 54 lies before it passes the radial on which the contacting portion 60 lies. It is thus behind the lead edge when it engages finger 52. In the operative position shown in FIG. I the area 58 is urged into engagement with the sheet carrying surface 20 by a biasing means 70. In this embodiment the means 70 is a spring 72 having one end 74 connected to the support 44 at a point 53 and the other end 76 connected to the finger 52 at a point 55. The spring 72 is connected such that when the finger 52 is in the position shown in FIG. I the point of connection 55 is below a centreline 75 extending through points 53 and 54. This over centre position keeps the area 58 against surface 20 in the pick off position shown in FIG. I.

As shown in enlarged form in FIG. 2, the sheet contacting portion 60 includes a re-entrant notch 62 having a first facet 64 inclined at an obtuse angle to the sheet carrying surface 20 at at the point of contact with the sheet material lead edge 32. In fact, at the moment of impact of the lead edge 32 with the facet 64 the conditions may be similar to those pertaining to proposed stripper fingers. For example, the angle, sharpness, surface area and pressure may be the same. At impact, the edge 65 of the facet 64, held at or near the surface 20 slides between the surface 20 and lead edge 32 to cause the edge to abut facet 64 and catch in notch 62. Thus, as the sheet material 30 moves along with the surface 20 from the position shown in FIG. I the lead edge 32 will drive against the sheet contacting portion 60 and cause the finger 52 to rotate counter clockwise stretching spring 72 until it reaches the position shown in FIG. 3 where the points 53, 54 and 55 lie on the centre-line 75. When the sheet material proceeds beyond the point shown in FIG. 3, that is, as the point 55 raises above or over centreline 75 the spring 72 will be free to contract. By so doing it will snap the finger 52 to the position shown in FIG. 4.

The basic principle the invention is that the lead edge 32 of the sheet material is engaged by a finger having a sheet contacting portion, and that immediately after engagement, the finger pivots about a point which is to the rear of the point of engagement of the contacting portion. Advantageously the sheet contacting portion 60 is a notch 62 having an angled facet 64. Tests show that when the finger engages the sheet edge 32 a surprisingly strong force becmes available as the sheet material assumes a curve during the action of stripping. The force is quite strong enough to cause the finger to pivot against a relatively strong spring whose initial purpose is to hold the first end of the finger against the photoreceptor drum surface. The electrostatic attraction of the sheet material 30 to the surface 20 transfers the movement of the surface 20 to the sheet material without slippage.

The over centre snap action of the finger 52 moving away from the surface 20 may tend to initially carry the lead adge 32 with it because of the configuration of the reentrant notch 62. However, the sheet contacting portion will normally move faster than the lead edge 32 thereby disengaging the front edge at a point where the forward portion of the sheet is stripped away from the surface 20. If, for some reason, the lead edge is not released from the notch 62 before it passes an upper edge 46 of the fixed support 44, the edge 46 will act as a release means and impact the underside of sheet material 30 to move the lead edge out of the notch 62 as shown in FIG. 4.

The height of surface 64 and size of notch 62 is shown to an exaggerated degree in the drawings for purposes of understanding. In practice a height for surface 64 of between 0.008 inches and 0.020 inches should be quite sufficient. The essential engagement between sheet edge 32 and stripper face 64 has to take place within the thickness of the thickest paper which will be utilised. This small step height greatly helps the release of the paper from the notch 62.

A tail portion 59 may be provided on the finger 52 to assist and control movement of the finger. Thus, for example, first and second stops 90, 95 respectively may define the arc of rotation of the finger 52 as shown for example in FIGS. 4 and 5. Moreover, advantageous results occur by making the second stop 95 movable in timed relation to the moving surface 20 so that when the finger 52 is snapped back to start the next stripping cycle the second stop 95 will be in a position to contact the tail 59 before the portion 58 reaches the surface. After contact the stop 95 moves slowly to bring the surface 58 gently into contact with the surface 20. First stop 90 advantageously may take the form of a lever mounted for pivotal movement about the point 92. In this configuration it serves a dual purpose as a stop for the finger after release as shown in FIG. 4 and as an impeller to return the finger to its stripping position as shown in FIG. 5. Suitable drive and timing means not shown may be provided.

From the foregoing it will be seen that the stripping device described provides very significant advantages over the prior proposals. For one, it does not transmit any significant reactive force of the paper against the surface 20. While there is a reaction as the lead edge 52 is lifted by facet 64 this is substantially instantaneous. Most importantly, the finger does not remain in contact with the surface 20 while the full length of the paper passes by it. This avoids finger wear and avoids wear to the photoconductive surface 20.

Also, because the finger contacts only the lead edge and does not otherwise contact the imaged side of the sheet material 30 it cannot smear or obliterate an unfixed image 22 on the sheet material 30. Moreover, it will not become contaminated and thereby does not require cleaning.

A further very significant advantage of the instant invention is that a plurality of stripping fingers 52 may be used without fear that a miss by one will produce catastrophic results. Also it allows a spreading of the forces involved over a number of fingers thereby reducing the force on each. This again improves efficiency and reduces wear.

FIG. 6 provides a schematic illustration of a plurality of fingers in position across the width of the surface 20. In the environment of the embodiment shown the lead edge 32 of the sheet material 30 will be a straight edge always aligned generally parallel to the axis 12 so that the plurality of fingers 52 may be exactly aligned to contact the lead edge 32 generally at the same time. It will be understood of course that other arrangements to accommodate other conditions are contemplated by this invention.

With the stripper fingers 52 on the back side, so to speak, of the sheet material 30 no harm will come if for some reason one finger should misengage or disengage from the lead edge 32. The rest will simply function normally. Also, in this position the fingers 52 may be used in rows, one behind the other to assure fail safe operation.

While the embodiment described has included a spring means 72 to bias the finger 52 into engagement with the surface 20 it will be understood that other means such as a counterbalanced weight may be used. In such case release may occur naturally and/or by means of a surface similar to 46 arranged in various similar positions. For example, surface 46 could be a roller surface, it could be stationary or move relative to the finger 52 under certain conditions. Thus, the surface 46 could be part of a member which is pivoted to the finger 52 so that movement of 52 will cause the surface 46 to swing into a disengaging position.

Similarly, the particular configuration of the notch may be varied to suit other conditions and environments. In one example a series of notches may be provided on a wheel attached to the first end 56 whereby different notches of the same or different configurations and characteristics may be alternately employed, as for example, to accommodate various different sheet material thicknesses or characteristics. This wheel may be manually changeable or automatically driven.

In a further embodiment the wheel may have similar notches and be driven to rotate at a circumferential speed slightly less than the expected lead edge speed so that engagement and release will function in timed relation.

The material used for the surface 58 may be of any suitable type such as for example hardened metal and long wearing plastics. For example, the surface 58 may be hardened steel having a coating of silver, or other plated material in the area of contact. The coated material can be of a softer or harder material from that of the disc according to which is found most advantageous for given conditions of working and for given surface material.

From the foregoing it will be appreciated that the invention provides an efficient and reliable stripping means that at least substantially overcomes the limitations of the prior proposals. It will also be understood that various modifications may be made to the specific details referred to herein without departing from the scope of the invention as defined in the appended claims.

What we claim is:

1. A device for stripping sheet material from a sheet carrying surface moving relative thereto including a finger having a sheet contacting portion at a first end adjacent said sheet carrying surface to contact the lead edge of a sheet of material on said surface, said finger being pivoted about a point spaced from and upstream of said sheet contacting portion whereby the pivot point is behind the lead edge of said sheet material when it is engaged by said sheet contacting portion;

means for biasing said sheet contacting portion toward said sheet carrying surface, said means for biasing said sheet contacting portion toward said sheet carrying surface is an over center spring which moves over center after said finger has been moved by said lead edge to a position where said lead edge is stripped from said sheet carrying surface.

2. A device according to claim 1 wherein said over centre movement of said sheet contacting portion is at a speed greater than the speed of said lead edge whereby said lead edge is disengaged from said sheet contacting portion.

3. A device according to claim 1 further including a means for controlling finger movement, said means including first and second stops positioned to contact the finger to define the extent of movement of said stripping finger.

4. A device according to claim 3 wherein said first stop contacts the finger after the sheet material has been stripped and disengaged, said first stop being movable to impel said stripping finger back towards its operative position.

5. A device according to claim 4 wherein said second stop contacts the finger just before it reaches its operative position and moves to assure gradual engagement of the finger with the sheet carrying surface.

* * * * *